US007208683B2

(12) United States Patent
Clark

(10) Patent No.: US 7,208,683 B2
(45) Date of Patent: Apr. 24, 2007

(54) DATA CABLE FOR MECHANICALLY DYNAMIC ENVIRONMENTS

(75) Inventor: William T. Clark, Lancaster, MA (US)

(73) Assignee: Belden Technologies, Inc., St. Louis, MO (US)

( * ) Notice: Subject to any disclaimer, the term of this patent is extended or adjusted under 35 U.S.C. 154(b) by 0 days.

(21) Appl. No.: 11/046,221

(22) Filed: Jan. 28, 2005

(65) Prior Publication Data

US 2006/0169478 A1 Aug. 3, 2006

(51) Int. Cl.
*H01R 7/00* (2006.01)

(52) U.S. Cl. ..... 174/110 R; 174/113 R; 174/27

(58) Field of Classification Search ..... 174/110 R, 174/113 R, 113 C, 115, 116, 36, 120 R
See application file for complete search history.

(56) References Cited

U.S. PATENT DOCUMENTS

| | | | |
|---|---|---|---|
| 483,285 | A | 9/1892 | Guilleaume |
| 867,659 | A | 10/1907 | Hoopes et al. |
| 1,008,370 | A | 11/1911 | Robillot |
| 1,132,452 | A | 3/1915 | Davis |
| 1,700,606 | A | 1/1929 | Beaver |
| 1,883,269 | A | 10/1932 | Yonkers |
| 1,940,917 | A | 12/1933 | Okazaki |
| 1,976,847 | A | 10/1934 | Gordon et al. |
| 1,977,209 | A | 10/1934 | Sargent |
| 1,995,201 | A | 3/1935 | Delon |
| 2,218,830 | A | 10/1940 | Rose et al. |
| 2,501,457 | A | 3/1950 | Thelin |
| 2,538,019 | A | 1/1951 | Lee |
| 2,882,676 | A | 4/1959 | Bryan et al. |
| 3,055,967 | A | 9/1962 | Bondon |
| 3,328,510 | A | 6/1967 | White |
| 3,340,112 | A | 9/1967 | Davis et al. |

(Continued)

FOREIGN PATENT DOCUMENTS

| | | |
|---|---|---|
| DE | 697 378 C | 1/1938 |

(Continued)

OTHER PUBLICATIONS

C&M Corporation, the "Engineering Design Guide," p. 11.

(Continued)

*Primary Examiner*—William H. Mayo, III
(74) *Attorney, Agent, or Firm*—Lowrie, Lando & Anastasi, LLP

(57) ABSTRACT

A multi-pair cable including a plurality of twisted pairs of insulated conductors, each having a closing lay length (twist lay length measured after the twisted pairs are cabled together with a particular cable lay) of less than about 0.6 inches. The plurality of twisted pairs are twisted together with a cable lay of greater than about three inches to form the cable. In some examples, the multi-pair cable may further comprise a separator disposed between the first and second twisted pairs. In another example, a ratio between a longest closing lay length and a shortest closing lay length in the cable is less than 1.65 inches. In another example, the cable further includes at least one additional twisted pair of conductors having a closing lay length that is greater than about 0.6 inches, and the cable lay length is less than about four inches.

17 Claims, 4 Drawing Sheets

U.S. PATENT DOCUMENTS 3,559,390 A 2/1971 Staschewski
3,603,715 A 9/1971 Eilhardt et al.
3,622,683 A 11/1971 Roberts et al.
3,644,659 A 2/1972 Campbell
3,649,744 A 3/1972 Coleman
3,819,443 A 6/1974 Simons et al.
3,881,052 A 4/1975 Britz et al.
3,911,200 A 10/1975 Simons et al.
4,034,148 A 7/1977 Lang
4,319,940 A 3/1982 Arroyo et al.
4,406,914 A 9/1983 Kincaid
4,487,992 A 12/1984 Tomita
4,500,748 A 2/1985 Klein
4,595,793 A 6/1986 Arroyo et al.
4,605,818 A 8/1986 Arroyo et al.
4,644,098 A 2/1987 Norris
4,647,714 A 3/1987 Goto
4,654,476 A 3/1987 Barnicol-Ottler et al.
4,697,051 A 9/1987 Beggs et al.
4,710,594 A 12/1987 Walling et al.
4,767,891 A 8/1988 Biegon et al.
4,777,325 A 10/1988 Siwinski
4,778,246 A 10/1988 Carroll
4,784,462 A 11/1988 Priaroggia
4,788,088 A 11/1988 Kohl
4,800,236 A 1/1989 Lemke
4,828,352 A 5/1989 Kraft
4,847,443 A 7/1989 Basconi
4,866,212 A 9/1989 Ingram
4,892,683 A 1/1990 Naseem
4,912,283 A 3/1990 O'Connor
4,970,352 A 11/1990 Satoh
4,987,394 A 1/1991 Harman et al.
5,010,210 A 4/1991 Sidi et al.
5,015,800 A 5/1991 Vaupotic et al.
5,037,999 A 8/1991 VanDeusen
5,043,530 A 8/1991 Davies
5,068,497 A 11/1991 Krieger
5,073,682 A 12/1991 Walling et al.
5,077,449 A 12/1991 Cornibert et al.
5,097,099 A 3/1992 Miller
5,107,076 A 4/1992 Bullock et al.
5,132,488 A 7/1992 Tessier et al.
5,132,490 A 7/1992 Aldissi
5,132,491 A 7/1992 Mulrooney
5,142,100 A 8/1992 Vaupotic
5,146,048 A 9/1992 Yutori et al.
5,149,915 A 9/1992 Brunker et al.
5,155,304 A 10/1992 Gossett et al.
5,170,010 A 12/1992 Aldissi
5,173,961 A 12/1992 Chiasson
5,177,809 A 1/1993 Zeidler
5,180,890 A 1/1993 Pendergrass
5,206,485 A 4/1993 Srubas et al.
5,212,350 A 5/1993 Gebs
5,216,202 A 6/1993 Yoshida et al.
5,220,130 A 6/1993 Walters
5,220,177 A 6/1993 Harris
5,245,134 A 9/1993 Vana, Jr. et al.
5,253,317 A 10/1993 Allen et al.
5,254,188 A 10/1993 Blew
5,298,680 A 3/1994 Kenny
5,304,739 A 4/1994 Klug et al.
5,313,020 A 5/1994 Sackett
5,371,484 A 12/1994 Nixon
5,393,933 A 2/1995 Goertz
5,399,813 A 3/1995 McNeill et al.
5,418,878 A 5/1995 Sass et al.
5,424,491 A 6/1995 Walling
5,493,071 A 2/1996 Newmoyer
5,514,837 A 5/1996 Kenny et al.
5,541,361 A 7/1996 Friesen et al.
5,544,270 A 8/1996 Clark et al.
5,574,250 A 11/1996 Hardie et al.
5,576,515 A 11/1996 Bleich et al.
5,658,406 A 8/1997 Walling et al.
5,666,452 A 9/1997 Deitz, Sr. et al.
5,699,467 A 12/1997 Kojima et al.
5,744,757 A 4/1998 Kenny et al.
5,767,441 A 6/1998 Brorein et al.
5,789,711 A * 8/1998 Gaeris et al. ..... 174/113 C
5,814,768 A 9/1998 Wessels et al.
5,821,466 A 10/1998 Clark et al.
5,821,467 A 10/1998 O'Brien et al.
5,834,697 A 11/1998 Baker et al.
5,841,073 A 11/1998 Randa et al.
5,883,334 A 3/1999 Newmoyer et al.
5,888,100 A 3/1999 Bofill et al.
5,900,588 A 5/1999 Springer et al.
5,920,672 A 7/1999 White
5,936,205 A 8/1999 Newmoyer
5,952,607 A 9/1999 Friesen et al.
5,952,615 A 9/1999 Prudhon
5,956,445 A 9/1999 Deitz, Sr. et al.
5,969,295 A * 10/1999 Boucino et al. ..... 174/113 C
5,990,419 A 11/1999 Bogese, II
6,037,546 A 3/2000 Mottine et al.
6,074,503 A 6/2000 Clark et al.
6,091,025 A 7/2000 Cotter et al.
6,150,612 A 11/2000 Grandy et al.
6,153,826 A 11/2000 Kenny et al.
6,162,992 A 12/2000 Clark et al.
6,194,663 B1 2/2001 Friesen et al.
6,248,954 B1 6/2001 Clark et al.
6,255,593 B1 7/2001 Reede
6,272,828 B1 8/2001 Walling et al.
6,273,977 B1 8/2001 Harden et al.
6,288,340 B1 9/2001 Arnould
6,300,573 B1 10/2001 Horie et al.
6,303,867 B1 10/2001 Clark et al.
6,310,295 B1 * 10/2001 Despard ..... 174/113 R
6,323,427 B1 11/2001 Rutledge
6,355,876 B1 3/2002 Morimoto
6,365,836 B1 * 4/2002 Blouin et al. ..... 174/113 C
6,441,308 B1 8/2002 Gagnon
6,462,268 B1 10/2002 Hazy et al.
6,506,976 B1 * 1/2003 Neveux, Jr. ..... 174/113 R
6,566,605 B1 * 5/2003 Prudhon ..... 174/113 C
6,566,607 B1 5/2003 Walling
6,570,095 B2 * 5/2003 Clark et al. ..... 174/113 R
6,596,944 B1 * 7/2003 Clark et al. ..... 174/113 C
6,639,152 B2 * 10/2003 Glew et al. ..... 174/113 C
6,800,811 B1 * 10/2004 Boucino ..... 174/113 C
6,812,408 B2 * 11/2004 Clark et al. ..... 174/113 R
6,818,832 B2 * 11/2004 Hopkinson et al. ..... 174/113 R
6,888,070 B1 * 5/2005 Prescott ..... 174/113 C
2002/0050394 A1 5/2002 Clark et al.
2002/0096358 A1 7/2002 Kazuhiro et al.
2003/0106704 A1 6/2003 Isley et al.
2004/0050578 A1 3/2004 Hudson
2004/0118593 A1 6/2004 Augustine et al.
2005/0092515 A1 5/2005 Robert et al.

FOREIGN PATENT DOCUMENTS

DE 90 11 484 U 10/1990
DE 43 36 230 C1 3/1995
EP 0 862 188 A1 * 2/1998
EP 1 085 530 A2 3/2001
EP 1 162 632 A2 * 5/2001
FR 694 100 A 11/1930
WO WO 2000/51142 8/2000

WO WO 2001/54142 A 7/2001

OTHER PUBLICATIONS

Images of Belden 1711A Datatwist 300 4PR23 shielded cable, Sep. 11, 1995.
PCT International Search Report mailed Jul. 29, 1998. (Citing DE 43 36 230 and US 3,819,443).
PCT International Search Report mailed Jul. 12, 2000. (Citing FR 694,100, DE 697,378 and US 5,789,711).
PCT International Search Report mailed Nov. 8, 2004 and Written Opinion. (Citing WO 01/54142, US2002/096358, DE90 11 484, EP 1 085 530, US 4,406,914 and WO 00/51142).
PCT International Search Report mailed Dec. 10, 2004. (Citing US 5,814,768, US 6,323,427 and US 5,834,697).
PCT International Search Report PCT/US2006/002314, dated Jun. 21, 2006, citing references US2003/106704A1; US2005/092515A1; and US2002/050394A1.

* cited by examiner

DATA CABLE FOR MECHANICALLY DYNAMIC ENVIRONMENTS

BACKGROUND

1. Field of the Invention

The present invention relates to high-speed data communications cables comprising at least two twisted pairs of insulated conductors. More particularly, the invention relates to high-speed data communications cables that may be exposed to force, stress, rough handing and/or other disturbances present in mechanically dynamic environments.

2. Discussion of the Related Art

High-speed data communications cables often include pairs of insulated conductors twisted together generally in a double-helix pattern about a longitudinal axis. Such an arrangement of insulated conductors, referred to herein as "twisted pairs," facilitates forming a balanced transmission line for data communications. One or more twisted pairs may subsequently be bundled and/or bound together to form a data communications cable.

A cable may undergo various mechanical stresses during handling and use. For example, cables may be exposed to rough handling during installation of a structured cabling architecture for a local area network (LAN), during cable pulling and tying, etc. In addition, cables may be employed in various industrial settings wherein the cable is likely to be subjected to often rigorous motion, various mechanical stresses such as bending and twisting, and/or general rough handling during ordinary use.

One example of relatively harsh treatment of cables occurs in automatic cable dispensing devices. In order to facilitate cable deployment and/or installation, a cable may be packaged and distributed in a container or housing having various mechanical features that automatically dispense cable during installation. Such housings are generally desirable with respect to simplifying and expediting cable deployment. However, the automatic features of such devices often apply forces and various mechanical stresses to the cable during operation. Such relatively harsh treatment may alter the configuration and/or arrangement of the twisted pairs making up the cable.

The Telecommunications Industry Association and the Electronics Industry Association (TIA/EIA) have developed standards specifying a number of performance categories that establish requirements for various operating characteristics of a cable. For example, a category 6 cable must meet requirements for cable impedance and return loss, signal attenuation and delay, crosstalk, etc. A category 6 cable is generally considered a high performance cable and, as such, return loss and crosstalk requirements may be particularly stringent.

The term "return loss" refers to a measure of the relationship between the transmitted electrical energy and reflected electrical energy along a transmission line (e.g., a data communications cable). For example, return loss may be measured as the ratio of the signal power transmitted into a system (e.g., the power generated at the source end of a cable) to the signal power that is reflected. Return loss is often indicated in decibel (dB) units. Reflected electrical energy may have various adverse effects on data transmission, including reduced output power, signal distortion and dispersion, signal loss (e.g., attenuation), etc. The severity of return loss effects may depend on frequency. For example, high frequency signals tend to be more sensitive to distortion effects associated with return loss. The return loss requirements for category 6 cables may therefore be rated in connection with transmission signal frequency. Accordingly, higher performance cables may be more vulnerable to return loss effects caused by rough handling of the cables.

A variety of factors may contribute to generating reflections that affect the return loss of a cable. For example, an impedance mismatch between a cable and a load that is coupled to the cable may cause reflections that adversely affect return loss. Other reflections may stem from unintended variation in cable properties, non-uniformities and/or discontinuities along the length of a cable. Mechanical stresses on conventional cables in mechanically dynamic environments may result in variation in the intended lay configuration of the cable which may degrade the cable's return loss characteristics such that the cable no longer meets the performance requirements of its intended category.

Referring to FIG. 1A, there is illustrated a perspective view of a twisted pair of insulated conductors 50. Twisted pair 50 may be one of a plurality of twisted pairs bundled together to form a data communications cable. Twisted pair 50 comprises a pair of conductors 60*a* and 60*b*, respectively insulated by insulators 62*a* and 62*b*. Ideally, the two insulated conductors making up twisted pair 50 should be in contact or maintain a uniform spacing or air gap along the entire twisted length of twisted pair 50. However, various factors, such as rough handling and/or a tendency of the insulated conductors to untwist may cause some separation between the two conductors at various points along the length of the twisted pair. For example, at a length $L_1$ along a longitudinal axis 64 of the twisted pair 50, the twisted pair may be positioned as intended with the insulators 62*a* and 62*b* in contact with one another. FIG. 1B is a cross-sectional diagram of the twisted pair 50 at length $L_1$, taken along line B—B. As illustrated in FIG. 1B, in such an arrangement, respective centers of conductors 60*a* and 60*b* are separated by a distance $d_1$, determined at least in part by the diameter of the conductors and the thickness of the insulators. This distance is referred to herein as the "center-to-center distance."

A characteristic impedance of twisted pair 50 may be related to several parameters including the diameter of the conductors 60*a* and 60*b*, the center-to-center distance, the dielectric constant of insulators 62*a* and 62*b*, etc. In order to impedance match a cable to a load (e.g., a network component), the cable may be rated with a particular characteristic impedance. For example, many radio frequency (RF) components may have characteristic impedances of 50, 75 or 100 Ohms. Therefore, many high frequency cables may similarly be rated with a characteristic impedance of 50, 75 or 100 Ohms so as to facilitate connecting of different RF loads. Often, the characteristic impedance is determined from the average impedance of the cable based on the intended arrangement (i.e., arrangements wherein the insulators are in contact or have a uniform, controlled air gap between them), as illustrated at length $L_1$ in FIGS. 1A and 1B. However, referring again to FIG. 1A, as discussed above, at a length $L_2$ along the longitudinal axis 64, the center-to-center spacing between conductors of the pair may separate or compress to some extent such that the insulators 62*a*, 62*b* no longer have the intended spacing due to, for example, bending, twisting and/or other rough handling of the cable. Accordingly, the center-to-center distance has increased to a distance $d_2$, as shown in FIG. 1C which is a cross-sectional diagram of the twisted pair taken along line C—C in FIG. 1A. At some arbitrary length $L_3$ (see FIG. 1A), the twisted pair 50 may have yet another different center-to-center distance between the two conductors. This variation in the center-to-center distance may cause the impedance of the twisted pair to vary along the length of the twisted pair 50, resulting in undesirable signal reflections that affect return loss.

In addition, when the insulators of a twisted pair are not in contact, the dielectric between the two conductors includes an amount of air, the amount depending on the extent of the separation. As a result, the dielectric composition of the twisted pair may vary along the longitudinal length of the twisted pair, causing further variation characteristic impedance of the twisted pair that may, in turn, produce unwanted signal reflections that degrade the return loss of the cable.

SUMMARY OF INVENTION

According to various aspects and embodiments of the invention, there is provided a twisted pair cable that may be particularly suitable for use in mechanically dynamic environments. Such a cable may have one of various lay configurations that facilitate stability under force and stresses such as bending, cornering, rigorous movement, rough handling, etc., that may arise in industrial environments and/or during installations using various automatic cable dispensing devices, as discussed below.

According to one embodiment, a multi-pair cable may comprise a plurality of twisted pairs of insulated conductors each having a closing lay length (twist lay length measured after the plurality of twisted pairs are cabled together with the particular cable lay) that is less than about 0.6 inches, the plurality of twisted pairs of insulated conductors including a first twisted pair and a second twisted pair, and the plurality of twisted pairs may be twisted together with a cable lay to form the multi-pair cable, the cable lay being greater than about 3 inches. In some embodiments, the multi-pair cable may further comprise a separator disposed between the first twisted pair and the second twisted pair.

In one example, a ratio between a longest closing lay length and a shortest closing lay length in the cable is less than 1.65 inches. In another example, the multi-pair cable further comprises at least one additional twisted pair of insulated conductors having a closing lay length that is greater than about 0.6 inches, and the cable lay length is less than about four inches.

According to another embodiment, a multi-pair cable comprises at least five twisted pairs of insulated conductors each having a closing lay length of less than about 0.6 inches, the plurality of twisted pairs of insulated conductors including a first twisted pair and a second twisted pair, wherein the plurality of twisted pairs are cabled together with a cable lay length to form the multi-pair cable, the cable lay length being greater than about seven inches. In one example, the multi-pair cable further comprises at least one additional twisted pair of insulated conductors having a closing lay length that is greater than about 0.6 inches.

According to yet another embodiment, a multi-pair cable comprises a first twisted pair of insulated conductors having a first closing lay length, a second twisted pair of insulated conductors having a second closing lay length, a third twisted pair of insulated conductors having a third closing lay length, and a fourth twisted pair of insulated conductors having a fourth closing lay length. The multi-pair cable also comprises a tape separator disposed among the first, second, third and fourth twisted pairs so as to separate the first twisted pair from the third twisted pair and arranged so as to not separate the first twisted pair from the second twisted pair. Each of the first, second, third and fourth closing lay lengths are less than about 0.6 inches, and the first, second, third and fourth twisted pairs and the tape separator are cabled together to form the multi-pair cable with a cable lay length that is less than about five inches. In one example, a ratio between the first closing lay length and the second closing lay length is greater than about 1.4 inches.

BRIEF DESCRIPTION OF DRAWINGS

Various embodiments of the invention, and aspects thereof, will now be discussed in detail with reference to the accompanying figures. In the figures, in which like reference numerals indicate like elements.

DETAILED DESCRIPTION

Figure 1A:
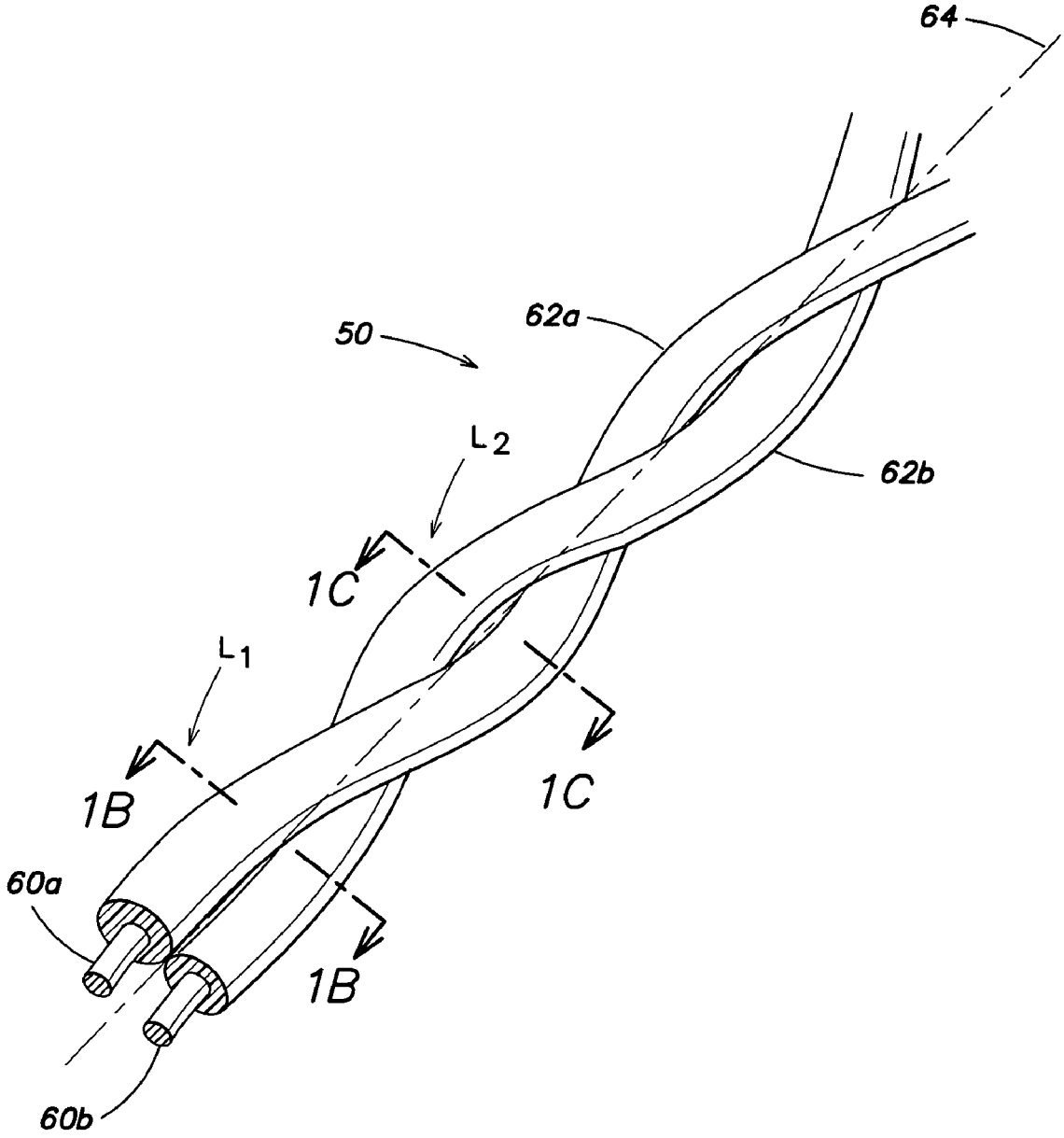
FIG. 1A (Prior Art)
FIG. 1A is a perspective view of a twisted pair of insulated conductors.
Figure 1B:
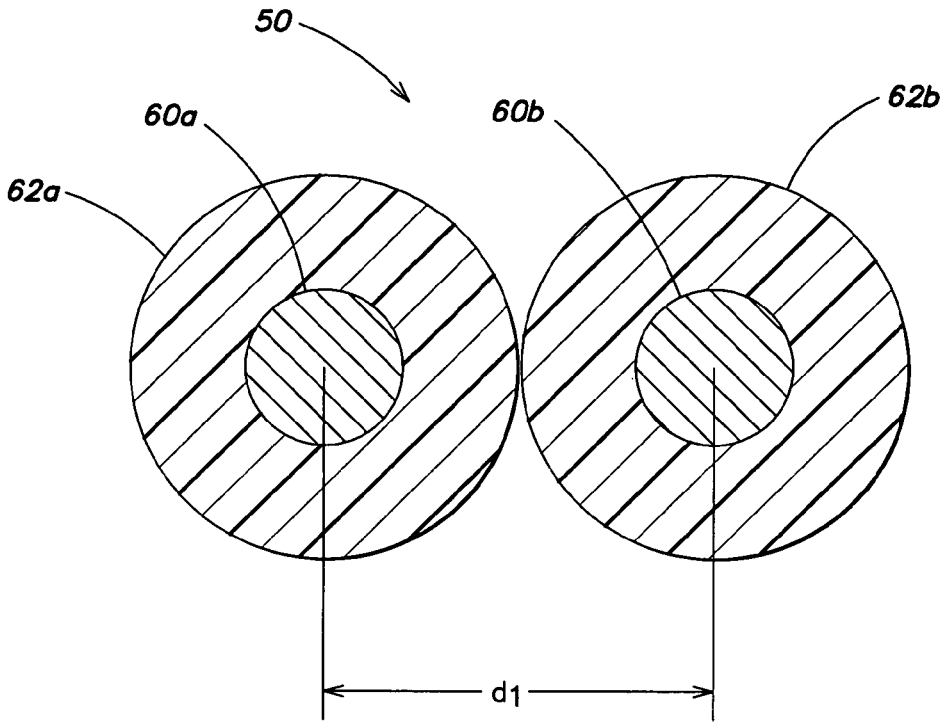
FIG. 1B (Prior Art)
FIG. 1B is a cross-sectional diagram of the twisted pair of conductors of FIG. 1A, taken along line B—B in FIG. 1A.
Figure 1C:
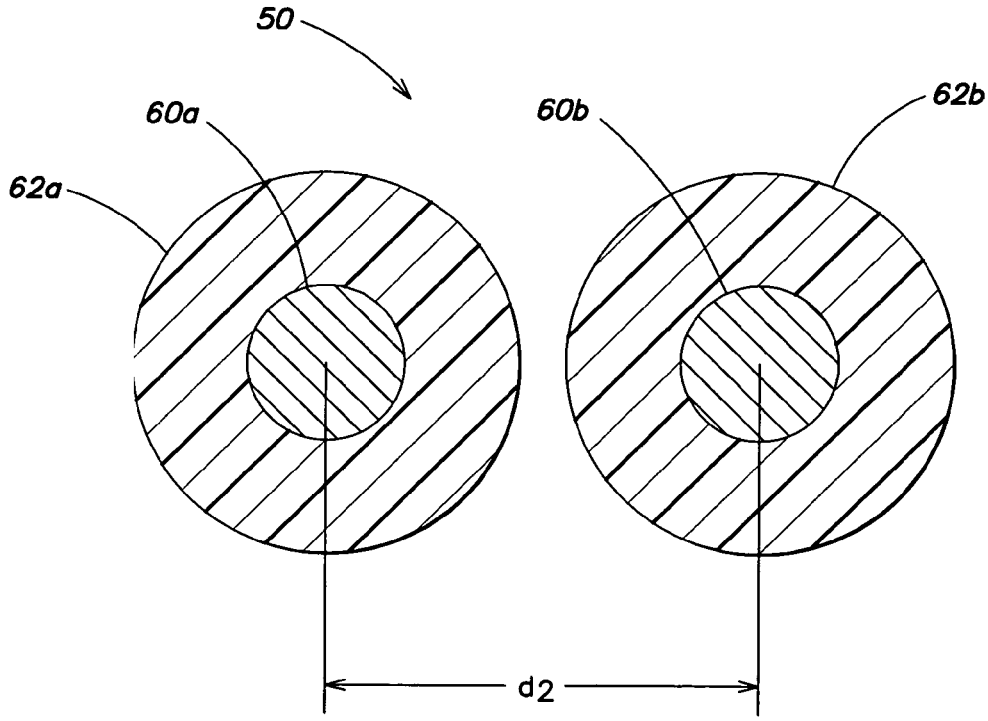
FIG. 1C (Prior Art)
FIG. 1C is a cross-sectional diagram of the twisted pair of conductors of FIG. 1A, taken along line C—C in FIG. 1A and showing separation of the insulated conductors.

Various conventional high performance cables may not be usable in mechanically dynamic environments or industrial settings due to their susceptibility to variation in the cable's configuration when introduced to various forces and mechanical stresses. Moreover, conventional cables may be vulnerable to performance degradation during installation, rough handling and/or other relatively harsh treatment.

Accordingly, Applicant has recognized and appreciated various lay configurations that facilitate stability under force and stresses such as bending, cornering, rigorous movement, rough handling, etc., that may arise in industrial environments and/or during installations using various automatic cable dispensing devices, etc. The term "lay configuration" as used herein refers to the arrangement of various components of a data communications cable. In particular, lay configuration refers to the various relationships within a cable, such as the relationships between conductors in a twisted pair, between the plurality of twisted pairs in a multi-pair cable, and between the plurality of twisted pairs and any separators, shields or other materials that may be present in the cable. The lay configuration also refers to the twist lay, cable lay, closing lay, center-to-center distances and pair-to-pair distances of the cable and twisted pairs within the cable. The term "closing lay" refers to the twist lay length of a pair measured after the twisted pairs are cabled together with a particular cable lay, as discussed below in reference to equations (1) and (2). The term "stability" or "stable" as used herein refers to a characteristic resistance to variation in an intended lay configuration. In particular, a stable lay configuration may be less vulnerable to variation and/or alteration in the intended cable arrangement when subjected to the various stresses that may arise in mechanically dynamic environments.

Cable manufacturers often rely in part on characteristics of a lay configuration to meet various performance requirements set forth in standards such as those developed by TIA/EIA. For example, in cables having a plurality of twisted pairs, the twist lay and twist direction of the twisted pairs may be varied with respect to one another in the cable. Varying the twist lays of the plurality of twisted pairs in a multi-pair cable may reduce the amount of signal induced by one twisted pair in adjacent and/or proximate twisted pairs in the cable. That is, varying the twist lay lengths may reduce crosstalk between twisted pairs. In addition, the direction of the twist may be alternated among the twisted pairs in a cable to further reduce the amount of crosstalk between the twisted pairs. The plurality of twisted pairs in a cable may be, in turn, twisted together about a longitudinal axis of the cable. This "cable lay" may help prevent variation in the twist lay, pair-to-pair distances, and other undesirable variation in the lay configuration of a cable that may result from bending, cornering, or otherwise mechanically disturbing the cable. For example, the twisted pairs of a multi-pair cable that are not twisted in a cable lay tend to separate when the cable is bent or cornered, which may cause variation in pair-to-pair relationships. As discussed in the foregoing, this variation may adversely affect the performance of a cable.

Another consideration of a lay configuration of a cable may be the relationship between each twist lay and the cable lay. When a cable lay is twisted in the same direction as a given pair twist lay (e.g., clockwise twist lay and clockwise cable lay), the cable lay tends to "tighten" the twisted pairs, that is, it shortens the twist lay length of a twisted pair. When a cable lay is twisted in the opposite direction of a given pair twist lay (e.g., a clockwise twist lay and a counter-clockwise cable lay), the cable tends to "loosen" the twisted pair, that is, it lengthens twist lay length of the twisted pair. Therefore, the cable lay may effect the twist lay either by increasing or decreasing the twist lay lengths of each twisted pair in the cable. This final pair twist lay (after cabling) is referred to herein as the "closing lay." The closing lay of a twisted pair may be determined from the reciprocal relationship between twist lay, cable lay and closing lay, as shown in equations 1 and 2 below. For a twisted pair wherein the cable lay is in the same direction as the twist lay of the twisted pair, the closing lay of the twisted pair is given by:

$$\frac{1}{L_{closing}} = \frac{1}{L_{TP}} + \frac{1}{L_{cable}} \tag{1}$$

where $L_{closing}$ is the closing lay of the twisted pair, $L_{TP}$ is the lay length of the twisted pair prior to being cabled and $L_{cable}$ is the cable lay length. Similarly, for a twisted pair wherein the cable lay is in the opposite direction as the twist lay of the twisted pair, the closing lay of the twisted pair is given by:

$$\frac{1}{L_{closing}} = \frac{1}{L_{TP}} - \frac{1}{L_{cable}} \tag{2}$$

Another consideration of the lay configuration of a cable is the relationship between the various pair lays in a cable. When adjacent twisted pairs have the same twist lay and/or twist direction, they tend to lie within a cable more closely spaced than when they have different twist lays and/or twist direction. Such close spacing increases the amount of undesirable crosstalk which occurs between the adjacent pairs. As discussed above, the twist lays of the twisted pairs in a multi-pair cable may be varied to prevent twisted pairs from aligning and contributing to crosstalk between the individual pairs. The extent of alignment that results in a multi-pair cable may depend on the range of twist lay lengths selected for a cable. In general, the smaller the range, the smaller the difference or delta that can be achieved between individual twist lay lengths. The twist lay deltas may also affect the amount of crosstalk in a cable, for example, smaller pair lay deltas tend to induce larger signals (i.e., increase crosstalk) in adjacent and/or proximate twisted pairs generally due to an increased alignment of the twisted pairs. One measurement indicative of the range of twist lays (and thus of twist lay deltas) is the ratio of the longest twist lay length to the shortest twist lay length.

Applicant has identified and appreciated that mechanical stresses on a cable may vary the lay configuration of a cable to the extent that the cable no longer exhibits satisfactory operating characteristics for its intended performance category, particularly with respect to high performance cables. Tests conducted by Applicant indicate that conventional lay configurations adapted to provide high performance cables may be susceptible to undesirable variation when exposed to mechanically dynamic environments. For example, a cable manufactured to meet category 6 requirements may no longer perform satisfactorily after various mechanical stresses that may occur during installation, rough handling, and/or use have been imposed on the cable.

In one embodiment, Applicant has recognized that twisted pairs having longer twist lay lengths may be more vulnerable to bending, cornering and/or rough handling. In particular, in a high performance cable exposed to mechanical stress, the twisted pairs having longer twist lay lengths, for example, in a range of about 0.744–0.850 inches (with a cable lay of about 5 inches), may fall short of requirements of an intended performance category while the twisted pairs with shorter twist lay lengths, for example, in a range of about 0.440–0.510 inches (with a 5 inch cable lay), may still perform satisfactorily. That is, the tighter twists are generally more resistant to movement and other mechanical disturbances.

However, while the shorter twist lays may be desirable in resisting separation, the tighter twists may require longer manufacturing times and may tend to decrease production output. In addition, tighter twists may require thicker insulators around the conductors, further driving up production costs. Signal attenuation and delay may also be adversely affected by reducing the pair lay lengths of the twisted pairs in a multi-pair cable. Moreover, decreasing the range of pair lay lengths (e.g., by decreasing the pair lay lengths of the more vulnerable twisted pairs having longer pair lay lengths) may adversely affect twisted pair alignment and may increase undesirable crosstalk between twisted pairs.

As described above, a cable may be less vulnerable to separation and/or other unintended variation in configuration when the plurality of twisted pairs are twisted together in a cable lay. In general, the shorter the cable lay length, the more resistant the cable is to separation, particularly with respect to pair-to-pair separation, and the less likely the cable is to deviate from its intended configuration. However, shorter cable lay lengths may increase production time and affect the manufacturing costs of producing cable. In addition, the cable lay effects the underlying pair lays in a cable by either increasing or decreasing the pair lay lengths of the twisted pairs. Accordingly, the tighter the cable lay, the more the individual pair lays will be affected. In addition, in a multi-pair cable, some twisted pairs may have a clockwise twist while others may have a counter-clockwise twist. As a result, a cable lay may have the effect of tightening some of the twisted pairs while loosening others and may bring certain twisted pairs into closer alignment, thereby increasing crosstalk. Accordingly, there may be various constraints on the cable lay so as to achieve a performance of the cable that meets requirements of the intended category.

In general, the lay configuration of a cable may contribute to its performance, stability, and production cost. However, the contributions may be often in competition and may conflict with one another. For example, tighter cable lays may tend to increase stability while increasing production costs. Similarly, tighter twist lays may tend to be more resistant to dynamic environments but may be more expensive and may adversely affect attenuation and transmission speeds. The tighter/shorter twist lays and cable lays tend to bunch the twisted pairs close together, resulting in a dense, relatively large mass being concentrated in the center of the cable which adds stability to the cable, making it less susceptible to changes in the lay configuration that may result from rough handling.

Applicant has determined various lay configurations for providing high performance cables that are generally resistant to mechanical stresses. In particular, Applicant has developed various lay configurations that may be used in any number of different cable arrangements to provide cables for mechanically dynamic environments (e.g., for automatic cable deployments, industrial settings, etc.) while maintaining the intended performance category of the cable.

According to one embodiment, a multi-pair cable is provided having a lay configuration that facilitates stability in mechanically dynamic environments. The lay configuration includes a plurality of twisted pairs arranged such that a cable lay length is greater than 3 inches, a ratio of the longest pair lay length of the twisted pairs in the cable to the shortest pair lay length of twisted pairs in the cable is less than 1.65, and each of the plurality of twisted pairs has a closing lay length less than 0.6 inches. Such a cable is capable of meeting category 6 performance requirements in some mechanically dynamic environments. It is to be appreciated that these numbers are provided as one specific example of a lay configuration that facilitates stability, however, the invention is not limited to the specific values given herein. Those of skill in the art may recognize that other configurations may be advantageous and will appreciate possible modifications to the examples described herein.

One example of a lay configuration according to one embodiment of the present invention that meets the requirements of a generally stress resistant cable is presented for illustration. In this example, the cable comprises four twisted pairs that are cabled together with a cable lay of about 5 inches. The closing twist lay lengths for each of the four twisted pairs are shown in Table 1.

TABLE 1

| Twisted Pair | Twist Lay Length (inches) |
|---|---|
| 1 | 0.365 |
| 2 | 0.540 |
| 3 | 0.412 |
| 4 | 0.587 |

In one embodiment, the above example may provide a stable lay configuration for a cable meeting the requirements set forth by performance category 6. Accordingly, the above example and various other arrangements may be well suited for providing category 6 or above rated cables intended for use in industrial settings, deployed from any of various automatic dispensing devices, and/or for use in circumstances or environments wherein a high performance cable is expected to undergo relatively harsh treatment. However, the invention is not limited to cables provided for such uses.

Many high performance cables employ some form of separator between the individual twisted pairs in a cable for isolation to further reduce crosstalk. Examples of such separators include cross-web separators such that those described in U.S. Pat. No. 6,074,503. Separators may also be arranged such that only certain pairs are separated from one another. U.S. Pat. No. 6,570,095 describes various configurable separators that facilitate relatively simple provision of any number of desirable arrangements of separators for separating twisted pairs in a multi-pair cable. The two above-identified patents are herein incorporated by reference in their entirety, and any configurations and arrangements described therein can be used in cables having lay configurations described herein.

Separators may be manufactured from various thermoplastics such as polyolefin. In plenum rated cables (i.e., cables that have satisfied various burn requirements such as those established by the Underwriters Laboratory (UL)), separators are often manufactured from fluoropolymer material such as fluoro ethylene propylene (FEP) due to the generally desirable burn and smoke characteristics of fluoropolymers. Separators may be fabricated to either be conductive or non-conductive. For example, a generally non-conductive separator may be made conductive if desired by adding a conductive material such as ferric powder or carbon black.

Separators are often provided in higher performance cables, such as cables meeting requirements of performance category 6 and above, to facilitate providing a cable that meets or exceeds the various operating requirements, such as crosstalk, of the intended performance category. However, the various methods of providing separators tends to make a cable more vulnerable to mechanical stresses, dynamic or pressure impinging environments, etc. This may be due, in part, to loss of pair-to-pair physical contact as well as loss of a substantial ground plane in the cable core that is usually inherent in cable designs not using internal separators. The magnitude of any non-desirable effects may vary by the type of separator used and the degree to which some or all of the pars are separated. There is a need for a high speed cable that uses a separator (to meet, for example, crosstalk specifications) and that is resistant to non-desirable effects that may be caused by rough handling of the cable (such as cable pulling, installation, cable tying etc.).

Figure 2:
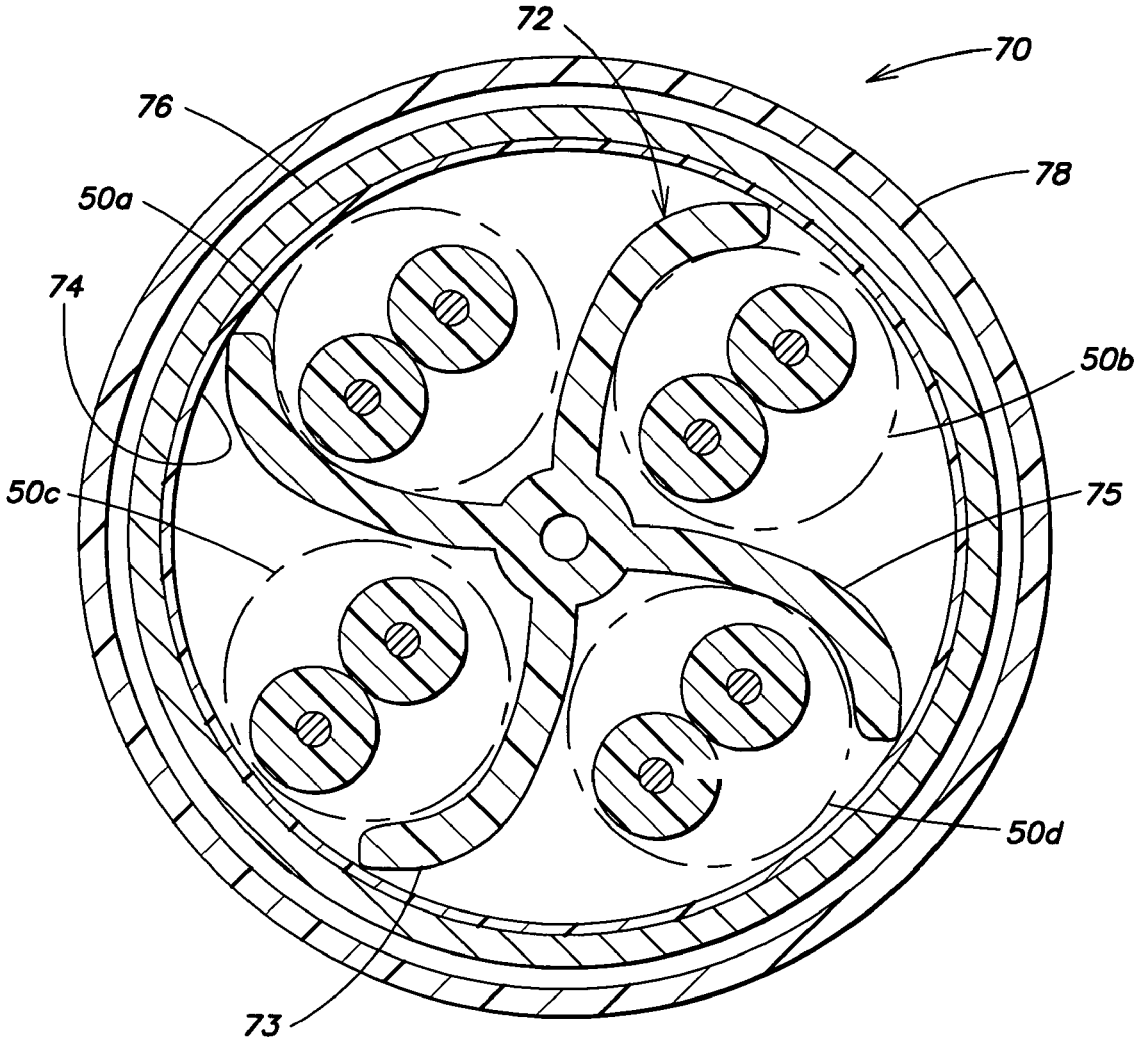
FIG. 2 is a diagram of one embodiment of a multi-pair cable employing a separator and having a stable lay configuration according to the present invention.

Referring to FIG. 2, there is illustrated a cross-section of a cable 70 having a cross or "+" shaped separator 72. Separator 72 forms spaces or channels 74*a*–74*d* for respective twisted pairs 50*a*–50*d* of the cable. While separator 72 may reduce crosstalk between the twisted pairs, immediate contact between twisted pairs 50*a*–50*d* is effectively eliminated. As discussed above, pair-to-pair contact may provide added stability and resistance to movement and variation within the cable. Accordingly, cables employing one more separators may be more vulnerable to variation in lay configuration when exposed to mechanically dynamic environments.

In particular, separator 72 may not perfectly conform to the twisted pairs such that air gap may exist within each channel. These air gaps may allow the twisted pairs additional freedom of movement and may exacerbate twist separation and other variations in the lay configuration that may result when the cable is handled roughly or undergoes mechanical stresses. Furthermore, air gaps may affect the pair-to-pair relationship and may cause further undesirable variation in the lay configurations of the twisted pairs. In addition to the general loss of stability, separators may also disturb the ground plane provided by the individual conductors that is inherent in cable designs that do not include internal separators. These factors may generally contribute to cables being more sensitive to mechanical stresses and/or rough handling that may occur during installation, cable pulling, cable tying, etc.

Applicant has recognized and determined various lay configurations that facilitate production of cables more resistant to mechanical stresses and dynamic environments suitable for cables employing separators. In one specific example, the multi-pair cable may be manufactured with a lay configuration wherein a cable lay length is greater than 3 inches, and each of the plurality of twisted pair conductors has a closing lay length of less than 0.6 inches. Particularly, the ratio between the longest twist lay length and the shortest twist lay length among the plurality of twisted pair conductors is less than about 1.65. However, it is to be appreciated that there may be many variations on this example and the invention is not limited to the specific values given herein.

Figure 3:
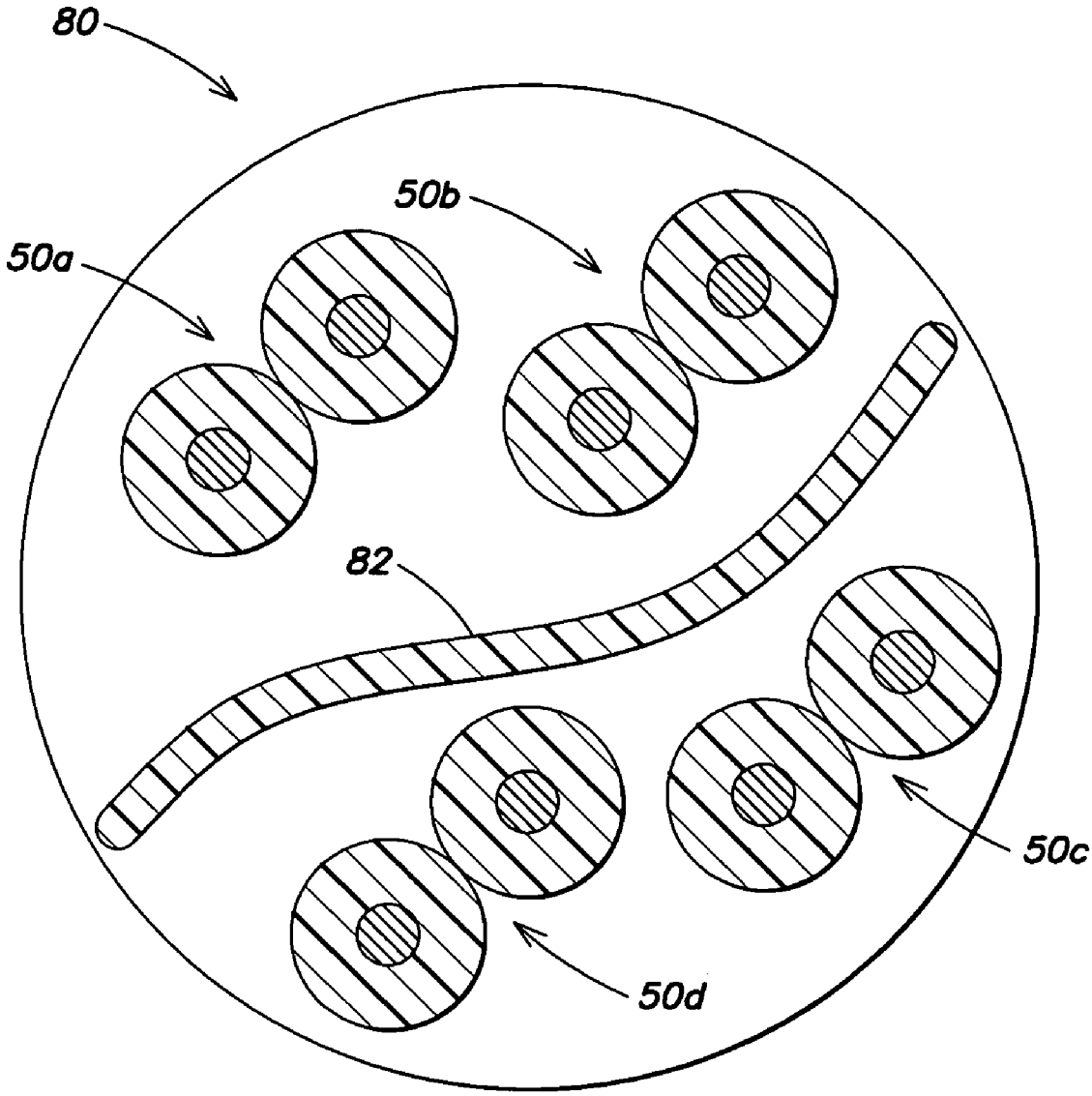
FIG. 3 is a diagram of another embodiment of a multi-pair cable employing a separator and having a stable lay configuration according to the present invention, the separator selectively separating some twisted pairs in the cable.

It is to be appreciated that the invention is not limited to cables employing a substantially "+" shaped separator as illustrated In FIG. 2, but that the separator may have a variety of profiles and may be arranged such that certain twisted pairs are selectively separated from one another while other pairs remain in pair-to-pair contact. For example, referring to FIG. 3, there is illustrated a cable 80 having four twisted pairs 50*a*–50*d* and a separator 82 that is arranged to separate twisted pairs 50*a* and 50*b* (that may remain in contact and form a first adjacent pair) from twisted pairs 50*c* and 50*d* (forming a second adjacent pair). As illustrated, the separator 82 separates the first adjacent pair from the second adjacent pair, but the pairs 50*a*, 50*b* are not separated and may remain in contact. Similarly, pairs 50*c* and 50*d* may not be separated by the separator 82 and may remain in contact. In some examples, the separator 82 may be substantially flat configurable tape, as shown in FIG. 3. The separators 72, 82 may be made of any suitable material such as polyolefins, various fluoropolymer materials, flame-retardant materials, a foamed polymer tape, such as, for example, a foamed flame retardant, cellular polyolefin or fluoropolymer like NEPTC PP500 "SuperBulk", a foamed fluorinated ethylene propylene (FEP), foamed polyvinyl chloride (PVC), a woven fiberglass tape, low dielectric constant, low dissipation factor, polymer materials, and the like.

It should be appreciated that the term separator is used to describe generally any of various forms, for example, star shaped separators, configurable and/or flexible tape separators or other arrangements, compositions and combinations of materials employed to separate and/or isolate one or more twisted pairs in a cable. As such, "separating" refers generally to acts of providing material between twisted pairs such that pair-to-pair contact between the twisted pairs is significantly eliminated.

According to one embodiment of the present invention, a multi-pair cable is provided having a lay configuration that facilitates stability in a cable employing a configurable tape separator e.g., as shown in FIG. 3, that selectively separates twisted pairs in the cable. Considering one specific example of a four pair cable having a tape separator, the lay configuration may be arranged such that a cable lay length is less than 5 inches, at least one of the plurality of twisted pairs of insulated conductors has a closing lay length greater than 0.6 inches. The presence of the separator allows two pair combinations (50*a*–50*b* and 50*c*–50*d*) to have physical contact and thus a pair having a twist lay length of greater than 0.6 inches may still meet desired performance requirements. In addition, because some pairs are separated from one another by the tape separator 28, the ratio between twist lay lengths may be decreased relative to a similar cable without a separator. For example, each of the adjacent pairs in the cable may have a ratio of a first pair lay length to a second, shorter pair lay length of greater than 1.40 (compare with the ratio of 1.65 in the example above where the cable may not have a separator). In yet another specific example, each of the twisted pairs may have pair lays such that a ratio of the longer pair lay length to the shorter pair lay length for each adjacent pair is greater than 1.40.

It is to be appreciated that any of the cables with different lay configurations described above may be finished in a number of ways. For example, the cable may optionally be provided with a binder 74 (illustrated in phantom in FIG. 2) that is wrapped around the separator 72 and the plurality of twisted pairs 50*a*–*d*. In one embodiment, the separator may be conductive, for example, an aluminum/mylar tape, with an aluminum layer on a side of the tape facing the plurality of twisted pairs. In this case, the binder 74 may also be conductive, for example, also an aluminum/mylar tape, with the aluminum layer of the tape facing the plurality of twisted pairs 50*a-d* so that the combination of the binder 74 and the separator 72 provide four electrically shielded, enclosed channels. With this embodiment, the four enclosed channels are isolated from one another to provide desired crosstalk isolation. Binder 74 may alternatively be constructed of paper, polyolefin, fabric or any other suitable material. In addition, the binder may be arranged such that is fully encloses (referred to as a closed binder) or partially encloses (referred to as an open binder) the twisted pairs in the cable.

According to another embodiment, cable 70 may further include a shield 76 that may be provided instead of a binder 76 or together with the binder 74, in which case the shield 76 may be laterally wrapped around the binder 74. The shield 76 may be made from any suitable conductive material, e.g., a foil or metal material. The shield may be applied over the separator and the twisted pairs before jacketing the cable with the jacket 78, and may reduce crosstalk between the twisted pairs, reduce alien crosstalk, and prevent the cable from causing or receiving electromagnetic interference. In particular, greater crosstalk isolation between the twisted pairs of the cable, and reduced alien crosstalk may also be achieved by using a conductive shield 76 that is, for example, a metal braid, a solid metal foil, or a conductive plastic that is in contact with ends 73 of the protrusions 75 of the separator 72. If the separator 72 is also conductive or semi-conductive, for example, the aluminum/mylar tape, then the combination of the separator and the shield may form conductive compartments that shield each twisted pair from the other twisted pairs.

Data communications cables such as cable 70 illustrated in FIG. 2 may be arranged including shields and/or binders to facilitate meeting stringent crosstalk requirements of high performance cables, for example, performance category 6. However, the additional material provided in the cable (e.g., binder, shielding, etc.) may render the cable more susceptible to variation when exposed to various mechanical stresses. Accordingly, any of the lay configurations described above may be applied to cable 70 to facilitate increased stability in a mechanically dynamic environment.

While some lay configurations described in the foregoing may increase production costs, Applicant has recognized that due to the particular sensitivity of high performance cables (e.g., category Se and above) to mechanically dynamic environments, providing a high performance cable capable of resisting the stresses of an industrial setting or that of automatic dispensing equipment may be generally desirable despite the increased production cost. For example, conventional high performance cables having potentially less expensive production costs, may be unusable in mechanically dynamic environments, industrial settings, etc., due to their vulnerability to variations caused by stresses in the environment resulting in often unacceptable performance degradation.

Multi-pair cables having higher pair counts (e.g., cables having greater than 5 twisted pairs) often have further considerations with respect to lay configuration. For example, as pair count increases, the cable lay length typically increases. This may be due in part to the fact that as the diameter of the cable increases as a result of an increased pair count, shorter cable lays tend to produce tight angles in the twisted pair that may effect attenuation and signal delay, and may also cause signal reflection that adversely effects return loss. Also, meeting crosstalk requirements in all combinations in a multi-pair cable becomes more difficult as the number of pairs in the cable increases. Therefore, Applicant has identified and recognized various lay configurations that may be suitable for providing cables with higher pair counts that are resistant to variation that often causes performance degradation in conventional cables.

In one embodiment according to the present invention, a multi-pair cable is provided having at least five twisted pairs of insulated conductors, wherein the at least five twisted pairs of insulated conductors are arranged such that a cable lay length is greater than about 7 inches and each of pairs of insulated conductors has a closing lay length less than about 0.6 inches. Twist lay lengths for one specific example of a twelve-pair cable are given below in Table 2. The overall cable formed with these twisted pairs may have a cable lay length, for example, in a range of about 8 inches to 14 inches.

TABLE 2

| Twisted Pair | Twist Lay Length (inches) |
|---|---|
| 1 | 0.390 |
| 2 | 0.335 |
| 3 | 0.350 |
| 4 | 0.580 |
| 5 | 0.365 |
| 6 | 0.430 |
| 7 | 0.335 |
| 8 | 0.410 |
| 9 | 0.590 |
| 10 | 0.470 |
| 11 | 0.540 |
| 12 | 0.450 |

In general, the above lay configuration, and variations thereof, may be used to provide a cable that meets at least the requirements of performance category 5(e) and that is resistant to mechanically dynamic environments.

In another embodiment according to the present invention, a high pair count cable is provided having approximately twenty five twisted pairs of insulated conductors, wherein the approximately 25 twisted pairs of insulated conductors are arranged such that a cable lay length is greater than about 10 inches and each of the at least twenty five twisted pairs of insulated conductors has a closing lay length less than about 0.6 inches. Closing twist lay lengths for one specific example of a 25-pair cable having a cable lay of about 14 inches are given below in Table 3.

TABLE 3

| Twisted pair | Twist Lay Length (inches) |
|---|---|
| 1 | 0.430 |
| 2 | 0.580 |
| 3 | 0.335 |
| 4 | 0.365 |
| 5 | 0.540 |
| 6 | 0.350 |
| 7 | 0.590 |
| 8 | 0.335 |
| 9 | 0.540 |
| 10 | 0.350 |
| 11 | 0.470 |
| 12 | 0.390 |
| 13 | 0.450 |
| 14 | 0.510 |
| 15 | 0.410 |
| 16 | 0.470 |
| 17 | 0.390 |
| 18 | 0.450 |
| 19 | 0.510 |
| 20 | 0.410 |
| 21 | 0.470 |
| 22 | 0.390 |
| 23 | 0.450 |
| 24 | 0.510 |
| 25 | 0.410 |

It should be appreciated that the various lay configurations according to the present invention as described herein may be used in connection with cables combining features and aspects from any of the various embodiments described in the foregoing. For example, numerous arrangements and combinations not specifically illustrated may be formed by combining features from the various illustrated and/or described embodiments that may benefit from stable lay configurations. Furthermore, the values (e.g., twist lay lengths) given in each described example are for the purpose of explanation and not intended to be limited. Those of skill in the art will recognize that the examples of cable lays and twist lay lengths may be varied, for example, depending on the desired operating frequency range of the cable and/or use of the cable. Accordingly, the invention is not limited to the arrangements specifically described herein.

For example, the various separators illustrated may be used with cables have any number of twisted pairs. In addition, shielding and binders may be used alone, in combination, with or without separators and/or in cables having any number of twisted pairs. Aspects, features and/or components from one embodiment may be combined with those from another embodiment without departing from the scope of the invention.

For example, Applicant has contemplated the application of stable lay configurations to numerous combinations and a variety of arrangements of multi-pair cables, beyond those illustratively discussed herein and/or to various combinations of various features described in the embodiments of the foregoing. Application of any of various lay configurations to cables having components not specifically discussed or combinations not specifically illustrated are possible, and are intended to be within the spirit and scope of the invention. Accordingly, the foregoing description and drawings are by way of example only. The scope of the invention should be determined from proper construction of the appended claims and their equivalents.

What is claimed is:

1. A multi-pair cable comprising:

a plurality of twisted pairs of insulated conductors consisting of four twisted pairs of insulated conductors each having a closing lay length that is less than about 0.6 inches, the plurality of twisted pairs of insulated conductors including a first twisted pair and a second twisted pair; and a separator disposed between the first twisted pair and the second twisted pair; wherein the plurality of twisted pairs are twisted together with a cable lay length to form the multi-pair cable, the cable lay being greater than about three inches.

2. The multi-pair cable as claimed in claim 1, wherein a ratio between a longest closing lay length and a shortest closing lay length in the cable is less than 1.65.

3. The multi-pair cable as claimed in claim 1, wherein the cable lay length is less than about four inches.

4. The multi-pair cable as claimed in claim 1, further comprising at least one of a binder and a jacket that substantially surrounds the plurality of twisted pairs of insulated conductors and the separator.

5. The multi-pair cable as claimed in claim 4, wherein the cable comprises the binder and wherein the binder comprises at least one of paper, a polyolefin material, fabric and a tape.

6. The multi-pair cable as claimed in claim 4, wherein the cable comprises the jacket and wherein the jacket comprises a thermoplastic material.

7. The multi-pair cable as claimed in claim 4, further comprising an electromagnetic shield disposed adjacent the binder or the jacket.

8. The multi-pair cable as claimed in claim 1, wherein the plurality of twisted pairs of insulated conductors includes a third twisted pair having a third closing lay length and a fourth twisted pair; and wherein the separator is disposed such that the first and third twisted pairs are not separated by the separator; wherein the first twisted pair has a first closing lay length; and wherein a ratio between the first closing lay and the third closing lay is at least 1.4 inches.

9. A multi-pair cable comprising:

a plurality of twisted pairs of insulated conductors consisting of twenty five twisted pairs of insulated conductors each having a closing lay length of less than about 0.6 inches, the plurality of twisted pairs of insulated conductors including a first twisted pair and a second twisted pair; and wherein the plurality of twisted pairs are cabled together with a cable lay length to form the multi-pair cable, the cable lay length being greater than about seven inches.

10. The multi-pair cable as claimed in claim 9, wherein the cable lay length is greater than about ten inches.

11. The multi-pair cable as claimed in claim 9, further comprising a jacket substantially surrounding the twenty five twisted pairs of insulated conductors.

12. A multi-pair cable comprising:

a plurality of twisted pairs of insulated conductors consisting of four twisted pairs of insulated conductors each having a closing lay length that is less than about 0.6 inches, the plurality of twisted pairs of insulated conductors including a first twisted pair having a first closing lay length and a second twisted pair having a second closing lay length;

wherein the plurality of twisted pairs are twisted together with a cable lay length to form the multi-pair cable, the cable lay length being greater than about three inches; and wherein a ratio between a longest closing lay length and a shortest closing lay length in the cable is less than 1.65.

13. The multi-pair cable as claimed in claim 12, further comprising a separator disposed between the first twisted pair and the second twisted pair.

14. The multi-pair cable as claimed in claim 12, wherein the cable lay length is less than approximately four inches.

15. The multi-pair cable as claimed in claim 12, further comprising: a separator disposed between the first twisted pair and the second twisted pair; wherein the cable lay length is less than about four inches.

16. A multi-pair cable comprising:

a plurality of twisted pairs of insulated conductors that consists of a first twisted pair of insulated conductors having a first closing lay length, a second twisted pair of insulated conductors having a second closing lay length, a third twisted pair of insulated conductors having a third closing lay length, and a fourth twisted pair of insulated conductors having a fourth closing lay length;

a tape separator disposed among the first, second, third and fourth twisted pairs so as to separate the first twisted pair from the third twisted pair and arranged so as to not separate the first twisted pair from the second twisted pair;

wherein each of the first, second, third and fourth closing lay lengths are less than about 0.6 inches; and wherein the first, second, third and fourth twisted pairs and the tape separator are cabled together to form the multi-pair cable with a cable lay length that is less than about five inches.

17. The multi-pair cable as claimed in claim 16, wherein a ratio between the first closing lay length and the second closing lay length is greater than about 1.4 inches.

* * * * *

UNITED STATES PATENT AND TRADEMARK OFFICE

CERTIFICATE OF CORRECTION

PATENT NO. : 7,208,683 B2
APPLICATION NO. : 11/046221
DATED : April 24, 2007
INVENTOR(S) : William T. Clark It is certified that error appears in the above-identified patent and that said Letters Patent is hereby corrected as shown below:

In column 11, line 2, "Se" should read --5e--.

Signed and Sealed this

Seventh Day of August, 2007

JON W. DUDAS
*Director of the United States Patent and Trademark Office*